US006057499A

United States Patent [19]

Basmadjian

[11] Patent Number: 6,057,499

[45] Date of Patent: May 2, 2000

[54] DUAL FUNCTION PERCUSSION INSTRUMENT

[76] Inventor: Edouard Basmadjian, 12205 Le Mesurier, Montreal, Quebec, Canada, H4K 2B2

[21] Appl. No.: 09/069,804

[22] Filed: Apr. 30, 1998

[51] Int. Cl.[7] ..... G10D 13/02

[52] U.S. Cl. ..... 84/411 R; 84/414

[58] Field of Search ..... 84/104, 411 R, 84/412–414, 421, 411 A

[56] References Cited

U.S. PATENT DOCUMENTS

| | | | |
|---|---|---|---|
| 2,563,346 | 8/1951 | Livingston . | |
| 3,533,324 | 10/1970 | Price . | |
| 4,337,684 | 7/1982 | Le Mert . | |
| 4,469,004 | 9/1984 | Kurosaki . | |
| 4,506,586 | 3/1985 | Brewer . | |
| 4,549,462 | 10/1985 | Hartry et al. . | |
| 4,583,442 | 4/1986 | Minor | 84/413 |
| 4,593,596 | 6/1986 | Gauger . | |
| 5,301,591 | 4/1994 | Greenberg | 84/411 R |
| 5,398,583 | 3/1995 | Cook . | |
| 5,581,044 | 12/1996 | Belli et al. | 84/414 |
| 5,583,307 | 12/1996 | Tobia, Jr. | 84/411 R |

*Primary Examiner*—Brian Sircus
*Assistant Examiner*—Marlon T. Fletcher
*Attorney, Agent, or Firm*—Swabey Ogilvy Renault; Robert Mitchell

[57] ABSTRACT

A double-headed musical percussion instrument comprises a quick removable substitute drum head mounted at one end of a drum shell and adapted to closely emulate the sound of a conventional drum while at the same time providing the structural rigidity required to transport other instruments inside of the drum shell. The invention further includes a quick removable support mechanism which is adapted to support a small bass drum in a raised position over the floor. The support mechanism also enables the adjustment of the axial position of a bass drum pedal assembly with respect to the bass drum thereby making the pedal action more comfortable to the user.

18 Claims, 2 Drawing Sheets

DUAL FUNCTION PERCUSSION INSTRUMENT

BACKGROUND OF THE INVENTION

1. Field of the Invention

The present invention relates to musical instruments and, more particularly, to a percussion instrument adapted as a carrying case for other smaller percussion instruments and a lid for such a case.

2. Description of the Prior Art

In the prior art, it is known to use the internal space of a musical bass drum to accommodate other percussive musical instruments for storage and transportation purposes. For instance, U.S. Pat. No. 4,469,004 issued to Kurosaki on Sep. 4, 1984 discloses a training bass drum comprised of a cylindrical hollow elongated body having rear and front ends thereof respectively closed by a conventional drum head and a detachable lid made of a particle board. The detachable lid is designed to contribute to the generation of small tone volume and thus it is not well adapted to closely emulate the sound of a conventional skin head. Accordingly, there is a need for a quick detachable lid which could be used for real musical performances.

As illustrated by the above mentioned U.S. Pat. No. 4,469,004 and U.S. Pat. No. 2,563,346, issued to Livingston on Aug. 7, 1951, it is also known to provide an auxiliary support mechanism to elevate a small diameter bass drum above a supporting surface, such as a floor, in order that the beater of a conventional bass drum pedal assembly beat the batter head of the bass drum in the central portion thereof. Although the above mentioned support mechanisms are effective, it has been found that there is a need for a quick disconnecting support mechanism which also enables the adjustment of the distance between the bass drum pedal assembly and the batter head of the bass drum so that the pedal's beater position is at the apex when striking the batter head thus consequently making the pedal's action more ergonomic to the musician.

SUMMARY OF THE INVENTION

It is therefore an aim of the present invention to provide a substitute drum head which is adapted to closely emulate the sound of a conventional skin head while at the same time being able to act as a lid for a case.

It is also an aim of the present invention to provide a percussion instrument which is adapted to internally accommodate other instruments for storage and transportation purposes.

It is a further aim of the present invention to provide a small diameter bass drum which is adapted to closely simulate the sound of a conventional bass drum.

It is a further aim of the present invention to provide a mounting bracket which enables the adjustment of the axial position of a bass drum pedal assembly with respect to a bass drum.

It is still an aim of the present invention to provide a detachable support mechanism for supporting a bass drum in a raised position over a supporting surface.

Therefore, in accordance with the present invention, there is provided a drum head assembly for forming one end of a double-headed musical drum means having a batter head mounted at an opposed end thereof. The head assembly comprises a head member including a substantially rigid plate means and a resilient member mounted to an underside of the plate means. An attachment means is provided for releasably attaching the head member to the musical drum means with the resilient member being disposed between the plate means and the musical drum means.

In a further construction in accordance with the present invention, the plate means comprises a disc made of a cross-laminated wood panel.

In a further construction in accordance with the present invention, the resilient member includes a substantially flat circular piece of resilient material.

In a further construction in accordance with the present invention, the attachment means include a number of latch assemblies regularly distributed around the head member and the musical drum means. Each latch assembly includes a catch means mounted peripherally to the head member and a hook means mounted to the musical drum means and displaceable between a locked position where the hook means exert a predetermine pressure on the catch means to draw the head member towards the musical drum means such as to compress the resilient member against a bearing edge of the musical drum means and a released position where the hook means is out of engagement with the catch means to enable removal of the head member from the musical drum means.

In accordance with the present invention, there is provided a double-headed musical bass drum comprising a drum shell, a rear bass drum batter head mounted at a first end of the drum shell, and a front bass drum head removably mounted at a second end of the drum shell. The front bass drum head includes a substantially rigid plate means and a resilient member mounted to an inner side of the plate means. Attachment means are provided for releasably attaching the front bass drum head to the musical bass drum with the resilient member facing the musical bass drum.

In a further construction in accordance with the present invention, support means are provided to support a small diameter drum shell in a raised position over a supporting surface. Typically, the drum shell has a relatively long axial dimension and a plurality of holes are defined in the drum shell in the vicinity of the second end thereof.

According to the present invention, there is provided a holder assembly for supporting a small diameter bass drum in a raised position over a supporting surface. The holder assembly generally comprises a support block, extension means protruding from the support block, and holding means mounted to a small diameter bass drum and defining aperture means to receive therein the extension means of the support block. The holding means has abutment means displaceable between a first position to retain the extension means in the aperture means and a second position to permit disengagement of the extension means from the aperture means thereby allowing quick removal of the support block from the small diameter bass drum.

According to the present invention, there is provided a mounting bracket for connecting a bass drum pedal assembly to a musical bass drum means at various axial positions with respect thereto. The bracket generally comprises a holding means mounted to a drum shell having a longitudinal axis, a slidable member slidably mounted with respect to the holding member for movements along the longitudinal axis of the drum shell, the slidable member being adapted to be connected to a bass drum pedal assembly, and locking means for releasably securing the slidable member in a desired axial position relative to the drum shell or more specifically to a batter head of the musical drum so that a beater of the bass drum pedal assembly can be at an optimal position when striking the batter head of the musical drum.

BRIEF DESCRIPTION OF THE DRAWINGS

Having thus generally described the nature of the present invention, reference will now be made to the accompanying drawings, showing by way of illustration a preferred embodiment thereof, and in which.

DESCRIPTION OF THE PREFERRED EMBODIMENTS

Figure 1:
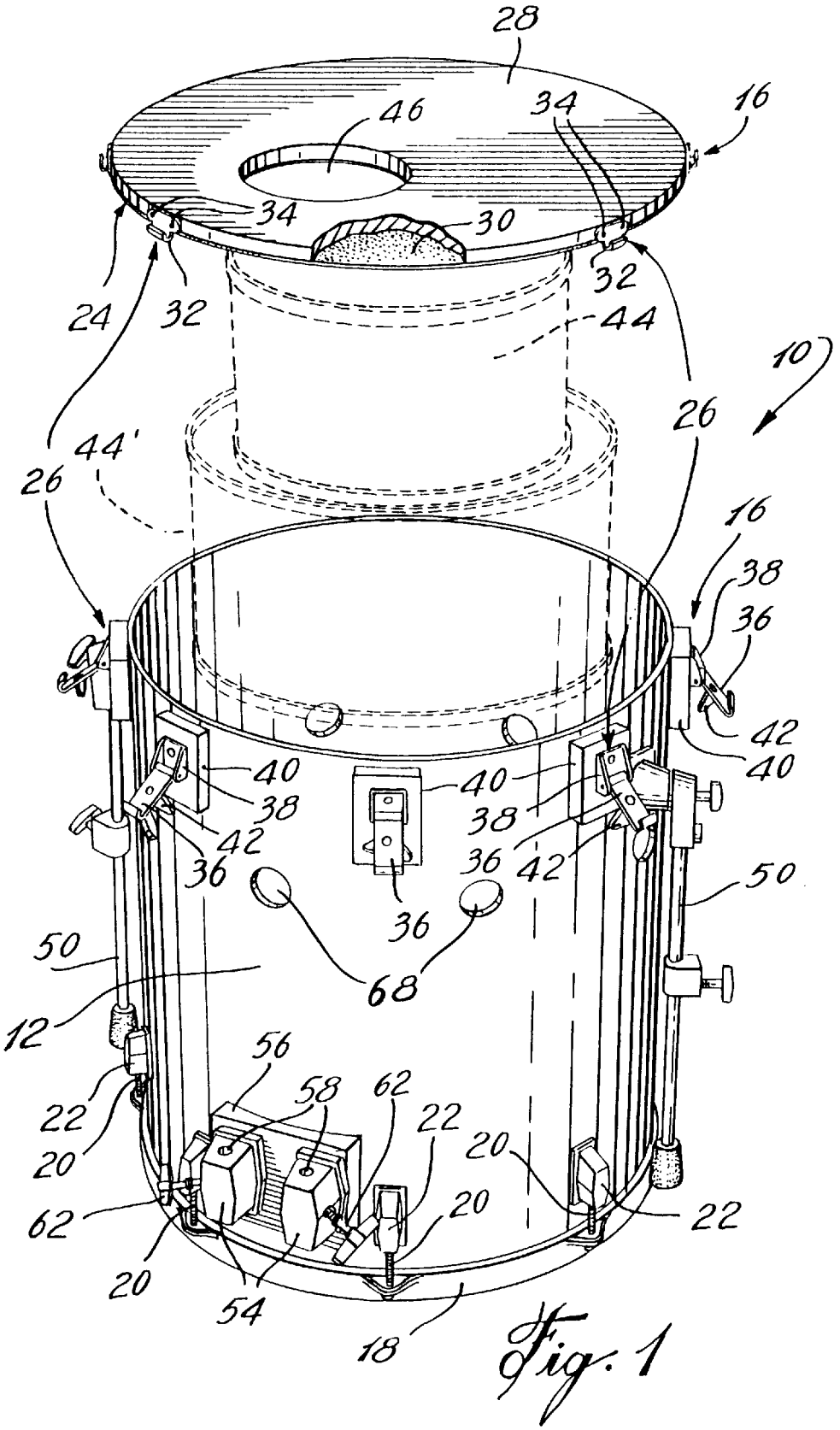
FIG. 1 is a perspective view of a percussion instrument in accordance with the present invention showing a drum head exploded away from a first end of a drum shell.

Now referring to the drawings, and in particular to FIGS. 1 and 2, a bass drum in accordance with the present invention and generally designated by numeral 10 will be described.

More specifically, the bass drum 10 includes an elongated cylindrical drum shell 12 having a conventional skin head 14 stretched over a rear end thereof and a front drum head assembly 16 mounted at a front end thereof.

As it is well known in the art, the conventional skin head 14 is held in place over the rear end of the bass drum 10 by means of a wood or metal rim 18. A number of tuning rods 20, generally eight, extend through apertures defined in the rim 18 and threadably engaged associated brackets known as lug casings 22 secured at uniformly spaced-apart positions on the exterior side of the drum shell 12. The tuning of the skin head 14 is accomplished by turning the tuning rods 20 into the lug casings 22.

Figure 2:
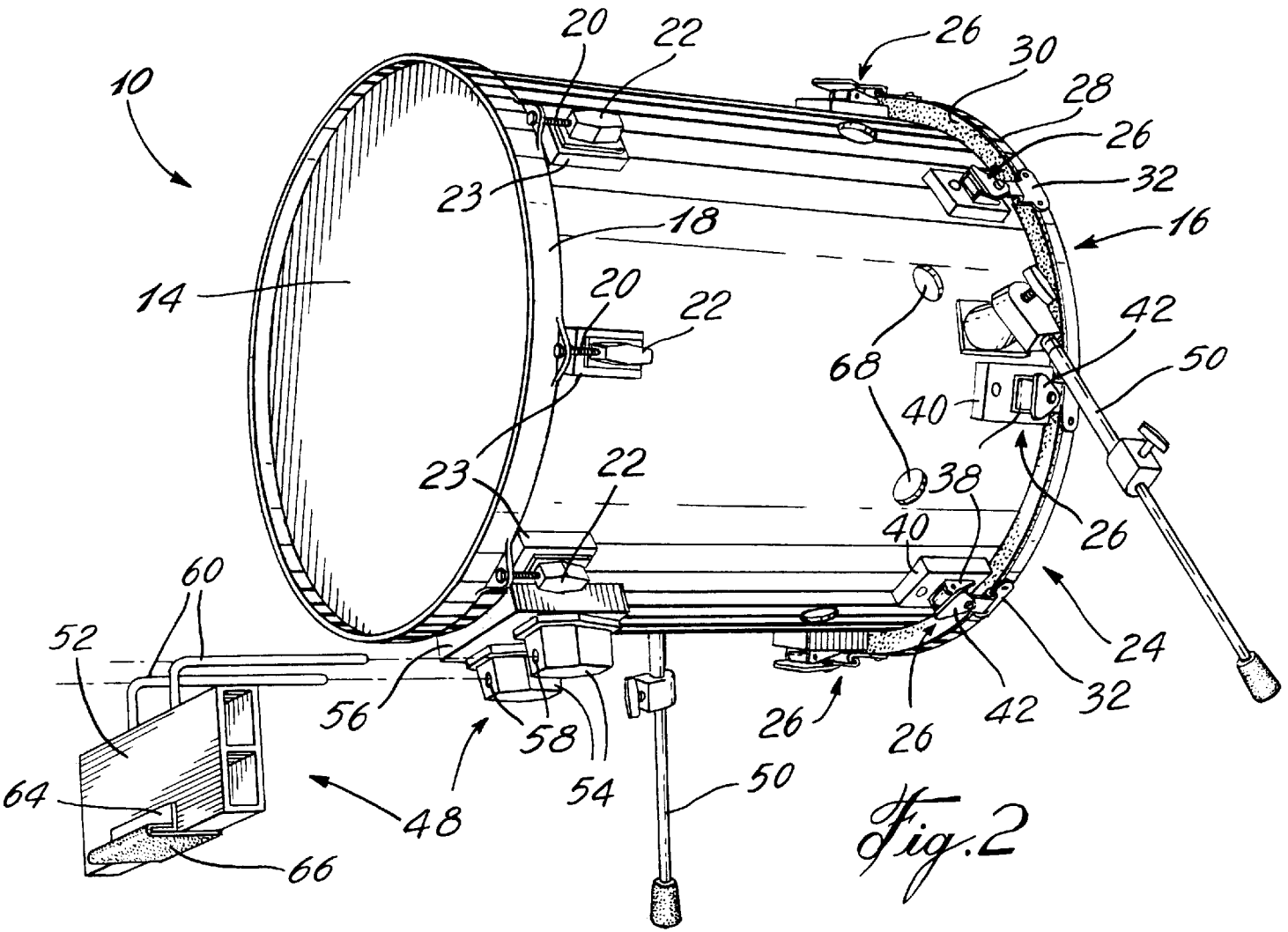
FIG. 2 is a perspective view of the embodiment of the small diameter bass drum shown in FIG. 1 and of a quick removable mounting bracket and support.

As seen in FIG. 2, it is contemplated to mount the lug casings 22 on respective wood blocks 23 so that the skin head 14 can extend beyond the bearing edge of the drum shell 12 in order to emphasize lower frequencies. It is noted that each wood block 23 has a concave underside so as to follow the curvature of the outer periphery of the drum shell 12. The opposed side of each wood block 23 is flat to provide an appropriate mounting surface for the lug casing 22.

The front drum head assembly 16 generally includes a head member 24 and a plurality of latch assemblies 26 circumferantially and regularly distributed around the periphery of the head member 24 and drum shell 12. According to a preferred embodiment of the present invention, eight latch assemblies 26 are provided to secure the head member 24 to the front end of the drum shell 12.

The head member 24 includes a substantially rigid circular flat plate 28 and a resilient disc 30 secured to an underside of the circular flat plate 28 by suitable conventional means. For instance, the resilient disc 30 may be glued to the underside of the circular flat plate 28. The flat plate 28 is preferably made of a cross-laminated wooden material, such as Russian plywood, as this type of wood is less likely subject to warp. For its part, the resilient disc 30 may be made of an elastic material such as a soft rubber. The role of the resilient disc 30 is to increase or emphasize lower frequencies and eliminates or at least decrease unwanted high overtones. The softer the rubber, the fatter the sound. According to one preferred embodiment of the present invention, a ½ inch thick plate of Russian plywood in combination with a ⅛ inch thick disc of soft rubber may be used to form the head member 24. It is noted that the diameters of the flat plate 28 and of the resilient disc 30 are similar and greater than that of the drum shell 12.

As seen in FIG. 1, each latch assembly 26 includes a catch element 32 radially mounted on the circumference of the circular flat plate 28 by a pair of fasteners 34 such as wood screws. Each latch assembly 26 further includes a hook member 36 pivotally connected to a bracket 38 mounted on a wood block 40 which is in turn secured to the exterior side of the drum shell 12.

Each wood block 40 has a concave underside so as to follow the curvature of the outer periphery of the drum shell 12. The opposed side of each wood block 40 is flat to provide an appropriate mounting surface for the brackets 38 which may be mounted to the shells by means of nuts and bolts.

A key 42 coupled to a translating mechanism (not shown) is connected to each hook member 36 to cause axial movements thereof.

In order to install the head member 24 at the front end of the drum shell 12, each catch element 32 is first positioned into engagement with corresponding hook member 36. Thereafter, the key 42 of each hook member 36 is turned in a closed position thereof to retract each hook member 36 and thus apply a predetermine tension to the head member 24 such as to firmly and uniformly maintain the resilient disc 30 against a bearing edge of the drum shell 12. The retaining force exerted by each latch assembly 26 is substantially perpendicular to the head member 24 as the catch element 32 and hook member 36 thereof are located at the same distance from a central axis of the drum shell 12.

It is noted that by mounting the bracket at a distance from the periphery of the drum shell by means of the wood blocks 40, the head member 24 may extend beyond the bearing edge of the drum shell around the entire circumference thereof. This contributes to increase lower frequencies. According to a preferred embodiment of the present invention the diameter of the head member 24 is one inch greater than that of the drum shell 12.

To remove the head member 24 from the drum shell 12, the keys 42 of the hook members 36 are turned in an opposite direction to a released position thereof to cause the extension of the hook members 36 thereby releasing the tension exerted on the head member 24. Then, the hook members 36 may be pivoted away from their respective catch elements 32 to permit disengagement of the head member 24 from the drum shell 12.

The above described latch assemblies 26 provide instant tuning, i.e. even tensioning, and thus permit rapid installation and removal of the head member 24. In other words, the latch assemblies 26 enable a user to quickly remove and replace the head member 24 without altering the tuning thereof and thus the sounding of the bass drum 10.

Because of the latch assemblies 26 and of the structural rigidity of the head member 24, the front drum head assembly 16 may advantageously be used as a lid for the drum shell 12 thereby enabling the utilization of the latter as a case. Accordingly, as depicted, in dotted-lines, in FIG. 1, the interior space of the drum shell 12 may accommodate other percussion instruments 44, such as tom-toms, for storage and transportation purposes. In the embodiment illustrated in FIG. 1, a pair of tom-toms 44 are disposed in an end to end relationship in the internal space defined by the drum shell 12. The tom-toms 44 may be placed in soft foam cases prior to their insertion into the drum shell 12 in order to protect the interior surface thereof. Once the tom-toms 44 have been accommodated in the drum shell 12 and the head member 24 has been installed at the front end of the drum shell 12, the bass drum 10 may be inserted into a conventional case.

A principal advantage of the above described head member 24 is that it may serve as a lid and still closely reproduce the sound of a conventional drum head for musical performances. More specifically, the resilient disc 30 enhances and emphasizes lower frequencies while eliminating or at least decreasing the unwanted higher overtones. The acoustic of the bass drum 10 is also influenced by the configuration, the dimensions and the materials of the head member 24. Furthermore, as seen in FIG. 1, a porthole 46 may be defined in the head member 24 to increase the lower frequencies of the bass drum 10. The porthole 46 also allows a microphone to be placed within the bass drum 10 if need be, for sound reinforcement purposes.

According to one aspect of the present invention, the diameter of the drum shell 12 is significantly smaller than that of a conventional bass drum so as to provide an interior space which generally corresponds to the outside diameter of the soft cases (not shown) containing the percussion instruments 44 thereby limiting movements thereof in the drum shell. By reducing the diameter of the drum shell 12, it is also possible to minimize the space required for mounting a drum set on a small stage. In that particular case, the axial length of the drum shell 12 is oversized in order to compensate acoustically for the drum's small diameter. According to one preferred embodiment of the present invention, the diameter of the drum shell 12 is in a range extending from 16 to 18 inches and the axial length thereof is in a range extending from 18 to 22 inches.

As the diameter of the bass drum according to the present invention is smaller than that of a conventional bass drum, the center thereof is closer to the ground and thus when used in combination with a conventional bass drum pedal assembly (not shown), the beater of the latter will beat the batter head of the small diameter bass drum 10 above the central portion thereof. Such an off-center beating is not suitable as it deteriorates musical tones to be generated and decreases volume considerably.

To obviate such an off-center beating problem, a holder assembly 48 is mounted at the rear or batter end of the small diameter bass drum 10. The holder assembly 48 cooperates with a pair of conventional orientable and adjustable legs 50 pivotally attached at the front end portion of the drum shell 12 to support the small diameter bass drum 10 in a raised position over a supporting surface such as a floor.

More specifically, the holder assembly 48 generally includes a support block 52 removably mounted to a pair of spaced-apart parallel holding members 54 which are in turn mounted to the drum shell 12. The holding members 54 are secured to a flat mounting surface of a wood block 56 fixed to the exterior side of the drum shell 12. The wood block 56 has a concave underside so as to follow the curvature of the outer periphery of the drum shell 12.

Each holding member 54 defines a longitudinal bore 58 for receiving therein an associated L-shaped rod 60 protruding from an upper surface of the support block 52. Accordingly, the support block 52 may be connected to the holding members 54 by slidably inserting the two spaced-apart parallel L-shaped rods 60 into the longitudinal bores 58 defined in the holding members 54, respectively.

As seen in FIG. 1, each holding member 54 further includes a threaded member 62 engaged in a threaded hole communicating with the longitudinal bore 58 and extending in a transversal direction with respect thereto. The threaded members 62 are used to secure the L-shaped-rods 60 in a fixed position in the longitudinal bores 58.

The support block 52 is preferably made of steel and includes a bottom extension 64 for connecting a conventional bass drum pedal assembly. A sheet of resilient material 66 may be glued or otherwise attached to the bottom extension 64 of the support block 52 to prevent metal-to-metal contact so as to decrease rattle.

It is pointed out that by inserting a longer or a smaller portion of the length of the L-shaped rods 60 into the holding members 54, it is possible to adjust the distance between the bass drum pedal assembly and the batter head of the bass drum 10 thereby allowing the beater of the pedal assembly to hit the head at the apex when it comes in contact with the batter head. This is an important characteristic of the present invention as it enables the user to properly adjust the interaction between the bass drum pedal assembly and the bass drum 10 as a function of the user's style thus making the pedal's action more ergonomic and comfortable to the user.

A further interesting advantage of the present holder assembly 48 resides in the fact that the support block 52 may be rapidly removed from the drum shell 12 when it is desired to place the bass drum 10 in a case for transportation purposes. Accordingly, the retractability of the holder assembly 48 allows the bass drum to fit in a smaller case.

According to another aspect of the present invention, a plurality of circumferantially and regularly distributed holes 68 may be defined in the drum shell 12 in the vicinity of the front end thereof to provide a bolder and fatter sound. According to a preferred embodiment of the present invention, the diameter of each hole 68 is about 2 to 3 inches. Coupled with the increase in depth of the drum shell 12, these holes 68 emphasize the lower frequencies in the sound generated from the bass drum 10.

In view of the foregoing, it can be said that the above described small diameter bass drum 10 is adapted to closely simulate the sound of a conventional bass drum with an increase in attack which is one ingredient or characteristic of the sound which is not available from a mixing console.

Furthermore, it is easily seen that the above described bass drum 10 has many advantages which can be summarized by the following: multi purpose, compact, sound quality, economical, convenient, etc.

I claim:

1. A drum head assembly for forming one end of a double-headed acoustic musical drum means having a batter head mounted at an opposed end thereof, said head assembly comprising a resonance acoustic head member including a substantially inelastic rigid plate means and a resilient member mounted to an underside of said plate means, and attachment means for releasably attaching said resonance acoustic head member to the musical drum means with said resilient member being disposed between said plate means and the acoustic musical drum means, thereby allowing said resonance acoustic head member to form a resonance case with said double-headed acoustic musical drum means.

2. A drum head assembly as defined in claim 1, wherein said plate means comprises a disc made of a cross-laminated wood panel.

3. A drum head assembly as defined in claim 1, wherein said resilient member includes a substantially flat circular piece of resilient material.

4. A drum head assembly as defined in claim 3, wherein said flat circular piece of resilient material substantially entirely covers said underside of said plate means.

5. A drum head assembly as defined in claim 4, wherein said flat circular piece of resilient material is glued to said underside of said head member.

6. A drum head assembly as defined in claim 1, wherein said head member defines a porthole.

7. A drum head assembly as defined in claim 1, wherein said attachment means include a number of latch assemblies regularly distributed around said resonance acoustic head member and said acoustic musical drum means, each said latch assembly including a catch means mounted peripherally to said inelastic rigid plate means, and a hook means mounted to the acoustic musical drum means and displaceable between a locked position where said hook means exert a predetermined pressure on said catch means to draw said resonance head member towards said acoustic musical drum means such as to compress said resilient member against a bearing edge of the acoustic musical drum means and a released position where said hook means is out of engagement with said catch means to enable quick removal of said resonance acoustic head member from said musical drum means.

8. A drum head assembly as defined in claim 7, wherein each said hook means is mounted to a block means secured to an exterior side of the acoustic musical drum means.

9. A drum head assembly as defined in claim 8, wherein said catch means and said hook means of each said latch assembly are coplanar when said resonance acoustic head member is locked in position at one end of the musical drum means.

10. A drum head assembly as defined in claim 9, wherein each said block means is made of wood.

11. A double-headed acoustic musical bass drum comprising a drum shell, a rear bass drum batter head mounted at a first end of said drum shell, a front resonance acoustic bass drum head removably mounted at a second end of said drum shell, said front resonance acoustic bass drum head including a substantially inelastic rigid plate means and a resilient member mounted to an inner side of said plate means, and attachment means for releasably attaching said front resonance acoustic bass drum head to said acoustic musical bass drum with said resilient member facing said acoustic musical bass drum.

12. A doubled-headed acoustic musical bass drum as defined in claim 11, wherein support means are provided to support said drum shell in a raised position over a supporting surface, said drum shell having a relatively long axial dimension and a relatively small diameter, and wherein a plurality of holes are defined in said drum shell in the vicinity of said second end thereof.

13. A double-headed acoustic musical bass drum as defined in claim 11, wherein said plate means includes a disc made of a cross-laminated wood panel.

14. A double-headed acoustic musical bass drum as defined in claim 11, wherein said resilient member includes a substantially flat circular piece of resilient material.

15. A double-headed acoustic musical bass drum as defined in claim 14, wherein said flat circular piece of resilient material substantially entirely covers said inner side of said plate means.

16. A double-headed acoustic musical bass drum as defined in claim 11, wherein said attachment means include a number of latch assemblies regularly distributed around said front bass drum head and said drum shell, each said latch assembly including a catch means mounted peripherally to said inelastic rigid plate means, and a hook means mounted to said drum shell and displaceable between a locked position where said hook means exert a predetermine pressure on said catch means to draw said front bass drum head towards said drum shell such as to compress said resilient member against a bearing edge of said drum shell and a released position where said hook means is out of engagement with said catch means to enable quick removal of said front bass drum head from said drum shell.

17. A double-headed acoustic musical bass drum as defined in claim 16, wherein said catch means and said hook means of each said latch assembly are coplanar when said front bass drum head is locked in position at the front end of said drum shell.

18. A double-headed acoustic musical bass drum as defined in claim 16, wherein each said hook means is mounted to a wooden block means secured to an exterior side of said drum shell.

* * * * *